US008614174B2

(12) United States Patent
Patil et al.

(10) Patent No.: US 8,614,174 B2
(45) Date of Patent: Dec. 24, 2013

(54) LUBRICANTS HAVING ALKYL CYCLOHEXYL 1,2-DICARBOXYLATES

(75) Inventors: Abhimanyu Onkar Patil, Westfield, NJ (US); Margaret May-Som Wu, Skillman, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 976 days.

(21) Appl. No.: 12/315,656

(22) Filed: Dec. 5, 2008

(65) Prior Publication Data

US 2010/0144572 A1 Jun. 10, 2010

(51) Int. Cl.
*C10M 111/04* (2006.01)

(52) U.S. Cl.
USPC ..... 508/506; 508/371

(58) Field of Classification Search
USPC ..... 508/363, 496, 506, 371
See application file for complete search history.

(56) References Cited

U.S. PATENT DOCUMENTS

| | | | | |
|---|---|---|---|---|
| 2,936,320 | A | 5/1960 | Benoit, Jr. et al. | |
| 3,251,771 | A | 5/1966 | Benoit, Jr. et al. | |
| 3,409,553 | A | 11/1968 | Scoggins et al. | |
| 4,464,277 | A | 8/1984 | Cousineau et al. | |
| 6,627,779 | B2 | 9/2003 | O'Rear | |
| 6,667,285 | B1 | 12/2003 | Kawahara et al. | |
| 6,815,402 | B2 * | 11/2004 | Tazaki et al. | 508/422 |
| 6,833,065 | B2 | 12/2004 | O'Rear | |
| 2005/0038283 | A1 * | 2/2005 | Kawahara et al. | 560/127 |
| 2007/0032391 | A1 * | 2/2007 | Tagawa et al. | 508/421 |

FOREIGN PATENT DOCUMENTS

| | | |
|---|---|---|
| EP | 1225213 A1 | 7/2002 |
| WO | WO 03/035585 | 5/2003 |

OTHER PUBLICATIONS

S. Gryglewicz, M. Stankiewicz, F. A. Oko and I. Surawska, "Esters of dicarboxylic acids as additives for lubricating oils", Tribology International, vol. 39, No. 6, pp. 560-564.

* cited by examiner

*Primary Examiner* — Jim Goloboy
(74) *Attorney, Agent, or Firm* — Robert A. Migliorini

(57) ABSTRACT

Provided is a lubricant having a first base stock of one or more alkyl cyclohexyl 1,2-dicarboxylate esters at 1 wt % to 50 wt % based on the total weight of the blend, and a second base stock at 99 wt % to 50 wt % based on the total weight of the blend, wherein the second base stock is chosen from (a) one or more $C_6$ to $C_{16}$ poly-α-olefins, (b) one or more gas-to-liquid materials, and (c) one or more Group I, II, and III oils. Also provided are methods of making such lubricant blends.

8 Claims, No Drawings

LUBRICANTS HAVING ALKYL CYCLOHEXYL 1,2-DICARBOXYLATES

FIELD

The present disclosure relates to lubricants useful in engine oils and in general lubricant applications. The present disclosure further relates to lubricants of non-polar base stocks that have improved solvency for polar additives.

BACKGROUND

Poly-α-olefins (PAOs) are important non-polar lube base stocks with many excellent lubricant properties, including high viscosity index (VI) and low volatility and are available in a wide viscosity range, i.e., a $Kv_{100}$ of about 2 to about 300 centistokes (cSt)). PAOs are disclosed as lube base stocks, for example, in U.S. Published Patent Application No. 20080177121 A1.

Other important lube base stocks are those derived from one or more Gas-to-Liquids materials (GTLs). GTL materials that are derived via one or more synthesis, combination, transformation, rearrangement, and/or degradation/deconstructive processes from gaseous carbon-containing compounds. GTLs are disclosed as lube base stocks, for example, in U.S. Published Application No. 2007/0265178, which is incorporated herein by reference.

Other important lube base stocks are the Groups I, II, and III base stocks. Groups I, II, and III base stocks are disclosed in "Synthetics, Mineral Oils and Bio-Based Lubricants, Chemistry and Technology" Edited by L. R. Rudnick, published by CRC Press, Taylor & Francis, 2005, which is incorporated herein by reference.

Base stocks of PAOs, GTLs, and Groups I to III exhibit relatively low polarity. This low polarity leads to low solubility and dispersancy for polar additives or sludge generated in lubricants containing PAOs and GTLs.

To compensate for the low polarity of base stocks of PAOs, GTLs, and Groups I to III, lubricant manufacturers commonly incorporate one or more polar co-base stocks. Commonly used co-base stocks are esters or alkylated naphthalenes, which are typically present in the lube base stock at about 1 wt % to about 50 wt % based on the total weight of the base and co-base stocks. Esters and alkylated naphthalenes are disclosed, for example, in U.S. Pat. Nos. 6,627,779 B2 and 6,833,065 B2 as well as WO 03/035585. Other co-base stocks include various dicarboxylic acid esters, which are disclosed, for example, in U.S. Pat. Nos. 2,936,320; 3,251,771; 3,409,553; 4,464,277; and 6,667,285.

It would be desirable to have a polar co-base stock that could be added to non-polar base stocks, such as PAOs, GTLs, and Groups I to III, to improve the solubility of additives and sludge therein.

SUMMARY

Provided by the present disclosure are lubricant blends and methods of making such lubricant blends.

According to the present disclosure, an advantageous lubricant comprises a first base stock of one or more alkyl cyclohexyl 1,2-dicarboxylate esters at 1 wt % to 50 wt % based on the total weight of the blend, and a second base stock at 99 wt % to 50 wt % based on the total weight of the blend, wherein the second base stock is chosen from (a) one or more $C_6$ to $C_{16}$ poly-α-olefins, (b) one or more gas-to-liquid materials, and (c) one or more Group I, II, and III oils.

A further aspect of the present disclosure relates to an advantageous method of making a lubricant comprising providing a first base stock of one or more alkyl cyclohexyl 1,2-dicarboxylate esters at 1 wt % to 50 wt % based on the total weight of the blend, and a second base stock at 99 wt % to 50 wt % based on the total weight of the blend, wherein the second base stock is chosen from (a) one or more $C_6$ to $C_{16}$ poly-α-olefins, (b) one or more gas-to-liquid materials, and (c) one or more Group I, II, and III oils, and blending the first base stock and the second base stock to form a lubricant blend.

These and other features and attributes of the disclosed lubricant blend compositions and methods of making such blends of the present disclosure and their advantageous applications and/or uses will be apparent from the detailed description which follows.

DETAILED DESCRIPTION

Alkyl cyclohexyl 1,2-dicarboxylate esters are effective as polar co-base lube stocks for PAOs and GTLs and can be blended therewith to obtain clear and bright liquids from very low to very high concentrations. The esters are amorphous, have low glass transition temperature ($T_g$) and are cost-competitive with other polar co-bases. The esters have advantageous lubrication properties, such as low volatility and low viscosity.

The blends of the present disclosure have a first base stock of one or more alkyl cyclohexyl 1,2-dicarboxylate esters at 1 wt % to 50 wt % and a second base stock of one or more $C_6$ to $C_{16}$ poly-α-olefins and/or gas-to-liquid materials at 99 wt % to 50 wt % based on the total weight of the blend. Preferred blends have 1 wt % to 50 wt % of the first base stock and 99 wt % to 50 wt % of the second base stock. More preferred blends have a first base stock at 2 wt % to 25 wt % and a second base stock at 98 wt % to 75 wt %.

Alkyl cyclohexyl 1,2-dicarboxylate esters can be chosen based on physical properties desired. Kinematic viscosity can vary from 2 cSt to 6 cSt and more preferably from 2.5 cSt to 5 cSt. Noack volatility can vary from 2 wt % to 20 wt % and more preferably from 5 wt % to 15 wt %. Glass transition temperature, $T_g$, can vary from 0° C. to −90° C. and more preferably from −10° C. to −80° C. Viscosity index, VI, can vary from 50 to 300 and more preferably from 70 to 250. Kinematic viscosity at 100° C. and 40° C. are measured according to ASTM method D445. Viscosity index is measured according to ASTM method D2270. Noack volatility is measured according to ASTM D5800. The pour points are measured according to ASTM D 97.

Particularly useful esters are the $C_9$-esters exhibiting a kinematic viscosity of 3.7 cSt (<4 cSt) and a Noack volatility in the desirable range of less than 15 wt % provide an excellent base stock for enhancing fuel economy in engines employing 5W-20 and 5W-30 type oils. The esters are "green" additive solubilizers because they do not contain N, S, or aromatic rings and because they also exhibit superior oxidative and cleanliness attributes.

The alkyl cyclohexyl 1,2-dicarboxylate esters can be synthesized by reacting cis-1.2-cyclohexanedicarboxylic anhydride with various alcohols. The esterification procedure is carried out in the presence of a catalyst.

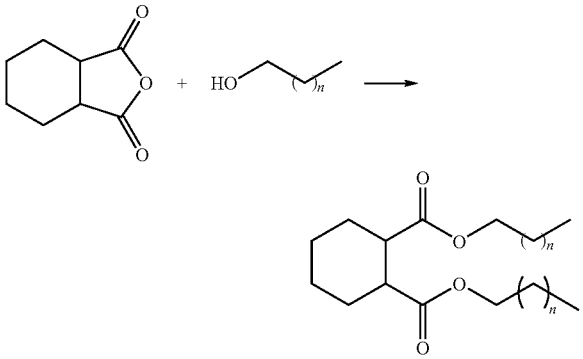

n = 8, 9, 10, 11, 12

Useful precursor alcohols include those having 6 to 15 carbon atoms or mixtures thereof and preferably 9 to 12 carbon atoms or mixtures thereof. Any isomeric form is possible, such as normal, iso-, and neo-. Examples of useful alcohols include n-nonanol, i-nonanol, n-decanol, i-decanol, n-undecanol, i-undecanol, n-dodecanol, and i-dodecanol. Alcohols having 9, 10, or 12 carbons are particularly preferred. Alcohols may be branched or unbranched. Alcohols may be primary, secondary, or tertiary.

The reactants may be contacted in the presence of a heterogeneous or a homogenous acid catalyst. The acid catalyst is used to increase the rate of reaction. The amount of catalyst is not critical, but at least enough catalyst must be used to provide a reasonable rate of esterification.

A conventional heterogeneous esterification catalyst may be used. One preferred heterogeneous catalyst that may be used is a sulfonic acid cation exchange resin having a macroreticular structure. These catalysts, their properties, and method of preparation are shown in U.S. Pat. No. 3,037,052, which is incorporated herein by reference. Such catalysts are available commercially and are sold under the trade name Amberlyst by Rohm & Haas of Philadelphia, Pa. Acidic zeolite catalysts may also be used.

Alternatively, a conventional homogenous esterification acid catalyst may be utilized in the reaction. Useful catalysts include sulfuric acid, phosphoric acid, p-toluene sulfonic acid, sodium bisulfate, potassium bisulfate, related catalysts, and the like. Other catalysts that may be used include esters of titanium or zirconium, such as tetraalkyl titanates or zirconates (e.g. tetraethyl titanate, tetraisopropyl titanate, tetrabutyl titanate, tetra-n-propyl zirconate). Also, metal oxides such as zinc oxide, alumina, and the like can be used. A preferred homogenous catalyst is 4-toluene sulfonic acid monohydrate. A preferred catalyst is titanium isopropoxide.

The esterification is carried out at a temperature, pressure, and for a period of time sufficient to effect the desired level of conversion. The reaction temperature is preferably 25 to 300° C., more preferably 50 to 250° C., and most preferably 100 to 220° C. The reaction is carried out for a time preferably from 1 to 48 hours, more preferably 2 to 36 hours, and most preferably 4 to 24 hours. Completion of reaction may be determined by gas chromatography analysis of the product composition.

Examples of useful alkyl cyclohexyl 1,2-dicarboxylate esters include the following: di(n-hexyl) 1,2-cyclohexanedicarboxylate, di(n-heptyl) 1,2-cyclohexanedicarboxylate, di(n-octyl) 1,2-cyclohexanedicarboxylate, di(n-nonyl) 1,2-cyclohexanedicarboxylate, di(n-decyl) 1,2-cyclohexanedicarboxylate, di(n-undecyl) 1,2-cyclohexanedicarboxylate, diisopropyl 1,2-cyclohexanedicarboxylate, dicyclohexyl 1,2-cyclohexanedicarboxylate, diisoheptyl 1,2-cyclohexanedicarboxylate, di(2-ethylhexyl) 1,2-cyclohexanedicarboxylate, diisononyl 1,2-cyclohexanedicarboxylate, di(3,5,5-trimethylhexyl) 1,2-cyclohexanedicarboxylate, di(2,6-dimethyl-4-heptyl) 1,2-cyclohexanedicarboxylate, diisodecyl 1,2-cyclohexanedicarboxylate, diisoundecyl 1,2-cyclohexanedicarboxylate, and combinations thereof. Preferred esters are the $C_9$ to $C_{12}$ cyclohexyldicarboxylates.

PAOs are a class of hydrocarbons that can be manufactured by the catalytic oligomerization (polymerization to low-molecular-weight products) of linear α-olefin (LAO) monomers. These typically range from 1-octene to 1-dodecene, with 1-decene being a preferred material, although oligomeric copolymers of lower olefins such as ethylene and propylene may also be used, including copolymers of ethylene with higher olefins as described in U.S. Pat. No. 4,956,122 and the patents referred to therein. PAO products have achieved importance in the lubricating oil market. Typically there are two classes of synthetic hydrocarbon fluids (SHF) produced from linear alpha-olefins, the two classes of SHF being denoted as PAO and HVI-PAO (high viscosity index PAOs). PAOs of different viscosity grades are typically produced using promoted $BF_3$ or $AlCl_3$ catalysts.

Specifically, PAOs may be produced by the polymerization of olefin feed in the presence of a catalyst such as $AlCl_3$, $BF_3$, or promoted $AlCl_3$ or $BF_3$. Processes for the production of PAOs are disclosed, for example, in the following patents: U.S. Pat. Nos. 3,149,178; 3,382,291; 3,742,082; 3,769,363; 3,780,128; 4,172,855 and 4,956,122, which are fully incorporated by reference. PAOs are also discussed in the following: Will, J. G. *Lubrication Fundamentals*, Marcel Dekker: New York, 1980. Subsequent to polymerization, the PAO lubricant range products are typically hydrogenated in order to reduce the residual unsaturation, generally to a level of greater than 90% of hydrogenation. High viscosity PAOs may be conveniently made by the polymerization of an alpha-olefin in the presence of a polymerization catalyst such as Friedel-Crafts catalysts. These include, for example, boron trifluoride, aluminum trichloride, or boron trifluoride, promoted with water, with alcohols such as ethanol, propanol, or butanol, with carboxylic acids, or with esters such as ethyl acetate or ethyl propionate or ether such as diethyl ether, and diisopropyl ether. (See for example, the methods disclosed by U.S. Pat. Nos. 4,149,178 and 3,382,291.) Other descriptions of PAO synthesis are found in the following: U.S. Pat. No. 3,742,082; U.S. Pat. No. 3,769,363; U.S. Pat. No. 3,876,720; U.S. Pat. No. 4,239,930; U.S. Pat. No. 4,367,352; U.S. Pat. No. 4,413,156; U.S. Pat. No. 4,434,408; U.S. Pat. No. 4,910,355; U.S. Pat. No. 4,956,122; and U.S. Pat. No. 5,068,487.

Another class of HVI-PAOs may be prepared by the action of a supported, reduced chromium catalyst with an alpha-olefin monomer. Such PAOs are described in U.S. Pat. No. 4,827,073; U.S. Pat. No. 4,827,064; U.S. Pat. No. 4,967,032; U.S. Pat. No. 4,926,004; and U.S. Pat. No. 4,914,254. Commercially available PAOs include SpectraSyn™ 2, 4, 5, 6, 8, 10, 40, 100 and SpectraSyn Ultra™ 150, SpectraSyn Ultra™ 300, SpectraSyn Ultra™ 1000, etc. (ExxonMobil Chemical Company, Houston, Tex.). Also included are PAOs prepared in the presence of a metallocene catalyst with a non-coordinating anion activator and hydrogen as discussed in U.S. Published Patent Application No. 20080177121.

GTL base oils comprise base stocks obtained from GTL materials that are derived via one or more synthesis, combination, transformation, rearrangement, and/or degradation/deconstructive processes from gaseous carbon-containing compounds. Preferably, the GTL base stocks are derived from the Fischer-Tropsch (F-T) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and examples of suitable catalysts are described in U.S. Pat. No. 4,568,663, each of which is incorporated herein by reference.

GTL base stocks are characterized typically as having kinematic viscosities at 100° C. of from 2 cSt to 50 cSt, preferably from 3 cSt to 50 cSt, more preferably from 3.5 cSt to 30 cSt. The GTL base stock and/or other hydrodewaxed, or hydroisomerized/catalytically (or solvent) dewaxed wax derived base stocks used in the present disclosure have kinematic viscosities at 100° C. in the range of 3.5 cSt to 7 cSt, preferably 4 cSt to 7 cSt, more preferably 4.5 cSt to 6.5 cSt.

GTL base stocks and base oils can be further characterized typically as having pour points of −5° C. or lower, preferably −10° C. or lower, more preferably −15° C. or lower, still more preferably −20° C. or lower, and under some conditions may have advantageous pour points of −25° C. or lower, with useful pour points of −30° C. to −40° C. or lower. In the present disclosure, however, the GTL base stocks used generally are those having pour points of −30° C. or higher, preferably −25° C. or higher, more preferably −20° C. or higher. References herein to pour point refer to measurement made by ASTM D97 and similar automated versions.

The GTL base stocks derived from GTL materials, especially hydrodewaxed or hydroisomerized/catalytically (or solvent) dewaxed F-T material derived base stocks, and other such wax-derived base stocks which are base stock components which can be used in this disclosure are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. For example, GTL base stocks that derive from GTL materials, preferably F-T materials, especially F-T wax, generally have a viscosity index of 130 or greater. References herein to viscosity index refer to ASTM method D2270.

In addition, the GTL base stocks are typically highly paraffinic (>90% saturates), and may contain mixtures of monocycloparaffins and multicyclo-paraffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than 10 ppm, and more typically less than 5 ppm of each of these elements. The sulfur and nitrogen content of GTL base stock and base oil obtained by the hydroisomerization/isodewaxing of F-T material, especially F-T wax, is very low.

In a preferred embodiment, GTL base stocks are paraffinic materials that consist predominantly of non-cyclic isoparaffins and only minor amounts of cycloparaffins. These GTL base stocks typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Examples of useful compositions of GTL base stocks are recited in U.S. Pat. Nos. 6,080,301; 6,090,989; and 6,165,949, for example, which are herein incorporated by reference.

Base stock(s), derived from waxy feeds, which are also suitable for use in this disclosure, are paraffinic fluids of lubricating viscosity derived from hydrodewaxed, or hydroisomerized/catalytically (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of 20 or greater, preferably 30 or greater, and mixtures of such isomerate/isodewaxate base stocks and base oils.

Slack waxes are waxes recovered from any waxy hydrocarbon oils, including synthetic oils such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack waxes secured from synthetic waxy oils such as F-T waxy oil will usually have zero or nil sulfur and/or nitrogen containing compound content. Slack waxes secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

Preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geq 4$), are such that: (a) $BI-0.5(CH_2 \geq 4)>15$; and (b) $BI+0.85\ (CH_2 \geq 4)<45$ as measured over said liquid hydrocarbon composition as a whole.

The preferred GTL base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geq 25.4$ and $(CH_2 \geq 4) \leq 22.5$. They have a nominal boiling point of 370° $C.^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of $C_{20}$ to $C_{40}$, a molecular weight of 280 to 562, a boiling range of 650° F. to 1050° F., and wherein said branched paraffins contain up to four alkyl branches and wherein the free carbon index of said branched paraffins is at least 3.

GTL base oils, and hydrodewaxed, or hydroisomerized/catalytically (or solvent) dewaxed wax base oils, for example, hydroisomerized or hydrodewaxed waxy synthesized hydrocarbon, e.g., Fischer-Tropsch waxy hydrocarbon base oils are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

The lubricant of the present disclosure may have Group I-III oils as second base stocks. Useful Group I-III base stocks have a $Kv_{100}$ (kinetic viscosity) of greater than 3 cSt to 5 cSt. API Groups I, II, and III represent base stocks typically refined from crude oil and are differentiated by viscosity index (VI), saturation content, and sulfur content.

The specifications for the lube base oils are defined in the API Interchange Guidelines (API Publication 1509) using sulfur content, saturates content, and viscosity index, as follows:

| Group | Sulfur (ppm) | Saturates (%) | Viscosity Index (VI) |
|---|---|---|---|
| I | <300 | <90 | 80-120 |
| II | <300 | >90 | 80-120 |
| III | <300 | >90 | >120 |
| IV | All Polyalphaoleins (PAOs) | | |
| V | All Stocks Not Included in Groups I-IV | | |

Manufacturing plants that make Group I base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lube production in the world is in the Group I category.

Manufacturing plants that make Group II base oils typically employ hydroprocessing such as hydrocracking or severe hydrotreating to increase the VI of the crude oil to the specifications value. The use of hydroprocessing typically increases the saturate content above 90 and reduced the sulfur below 300 ppm. Approximately 10% of the lube base oil production in the world is in the Group II category, and about 30% of U.S. production is Group II.

Manufacturing plants that make Group III base oils typically employ wax isomerization technology to make very high VI products. Since the starting feed is waxy vacuum gas oil (VGO) or wax which contains all saturates and little sulfur, the Group III products have saturate contains above 90 and sulfur content below 300 ppm.

A detailed description of Groups I, II, and III base stock can be found in "Synthetics, Mineral Oils and Bio-Based Lubricants, Chemistry and Technology" Edited by L. R. Rudnick, published by CRC Press, Taylor & Francis, 2005, which is incorporated herein by reference.

The lubricant of the present disclosure may have other Group V co-base stocks, such as esters. The esters of choice are dibasic esters (such as adipate ester, ditridecyl adipate), mono-basic esters, polyol esters, including pentherythyol (TMP esters), and phthalate esters. The alkylated aromatics of choice are alkylbenzene, alkylated naphthalene and other alkylated aromatics such as alkylated diphenylether, diphenylsulfide, biphenyl, and polyalkylene glycol. A detailed description of suitable Group V base stocks can be found in "Synthetics, Mineral Oils and Bio-Based Lubricants, Chemistry and Technology" Edited by L. R. Rudnick, published by CRC Press, Taylor & Francis, 2005.

The lubricant of the present disclosure may optionally include lube base oil additives such as detergents, dispersants, antioxidants, anti-wear additives, pour point depressants, viscosity index modifiers, friction modifiers, defoaming agents, corrosion inhibitors, wetting agents, densifiers, fluid-loss additives, rust inhibitors, and the like. The additives are incorporated into the blend to make a finished lubricant that has desired viscosity and physical properties. Typically, additives will make up about 10 wt % or less of the lubricant.

In a particular embodiment, the lubricant is substantially free of aliphatic saturated branched-chain carboxylic acid monoalkyl esters disclosed in formula (1) of U.S. Pat. No. 6,667,285 B1.

The lubricant can be employed in a variety of end uses, such as a lubricant oil, an industrial oil, a hydrolytic oil, an engine oil, and a grease.

The following are examples of the present disclosure and are not to be construed as limiting.

EXAMPLES

Preparation of Esters

Three 1,2-cyclohexanedicarboxylic esters were synthesized by reaction of 1,2-cyclohexanedicarboxylic anhydride and various ($C_9$, $C_{10}$, $C_{12}$) alcohols. The lube properties and product performance of these esters were evaluated to develop structure-property-performance knowledge for these Gr. V base stocks. The esterification synthesized is shown in the following reaction sequence:

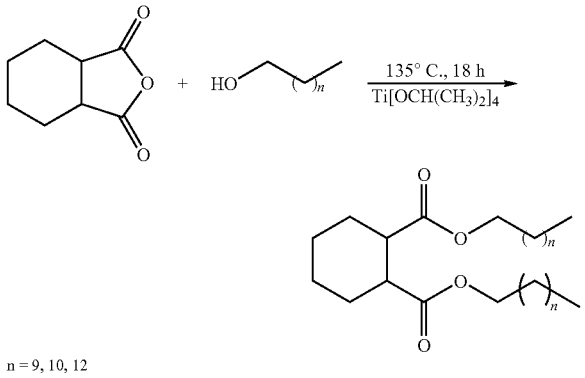

Exemplary Ester #1

Synthesis of Nonanyol Cyclohexane-1,2-dicarboxylate (25304-34)

Cyclohexane dicarboxylic anhydride (30.9 g, FW. 154.2), 1-nonanol (63.5 g, FW. 144.3) and titanium isopropoxide (0.28 g, FW. 284.2, 0.5%) were mixed in a 500 milliliter (ml) three-neck flask along with 100 ml xylene. The solution was brought to reflux and kept stirring at 135° C. to 140° C. for 18 hours with water condenser and Dean-Stark trap. 4.0 ml water was trapped after 5 hours. 4.1 ml water was trapped over 18 hours. Excess xylene was removed by rotary-evaporator. Residual xylene and unreacted nonayol alcohol was removed by vacuum oven at 5.0 mm Hg and 160° C. 87.6 g yellow viscous liquid was obtained. The yield was 98.9 mole %. Product structure and purity were confirmed by IR and GC-MS analysis.

Exemplary Ester #2

Synthesis of Decanyol Cyclohexane-1,2-dicarboxylate (25304-31)

Cyclohexane dicarboxylic anhydride (30.9 g, FW. 154.2), 1-decanol (77.6 g, FW. 158.3) and titanium isopropoxide (0.28 g, FW. 284.2, 0.5%) were mixed in a 500 ml three-neck flask along with 100 ml xylene. The reaction was brought to reflux and kept stirring at 135° C. to 140° C. for 18 hours with water condenser and Dean-Stark trap. 4.0 ml water was trapped after 5 hours. 4.4 ml water was trapped over 18 hours. Excess xylene was removed by rotary-evaporator. Residual xylene and unreacted decanyol alcohol was removed by vacuum oven at 5.0 mm Hg and 180° C. 92.5 g yellow viscous liquid was obtained. The yield was 99.5%. Product structure and purity were confirmed by IR and GC-MS analysis.

Exemplary Ester #3

Synthesis of Dodecanyol Cyclohexane-1,2-dicarboxylate (25304-37)

Cyclohexane dicarboxylic anhydride (30.9 g, FW. 154.2), undecanyol alcohol 1-dodecanol (78.3 g, FW. 186.33) and titanium isopropoxide (0.28 g, FW. 284.2, 0.5%) were mixed in a 500 ml three neck flask along with 100 ml xylene. The reaction was brought to reflux and kept stirring at 135° C. to 140° C. for 18 hours with water condenser and Dean-Stark trap. 4.5 ml water was trapped over 18 hours. Excess xylene was removed by rotary-evaporator. Residual xylene and unreacted undecanyol alcohol was removed by vacuum oven at 5.0 mm Hg and 180° C. 92.0 g yellow viscous liquid was obtained. The yield was 93.7%. Product structure and purity were confirmed by IR and GC-MS analysis.

The three esters in Examples 1 to 3 were evaluated for the following: kinematic viscosities (Kv), viscosity (VI), pour point depressant (PPD) temperature, and Noack volatility. Kinematic viscosity was measured according to ASTM method D445. Viscosity index was measured according to ASTM method D2270. Noack volatility was measured according to ASTM D5800. The pour points are measured according to ASTM D 97. The results are set forth in Table 1.

TABLE 1

(Lubricant properties of alkyl cyclohexyl 1,2-dicarboxylate esters)

| Sample # | Cyclohexanoate | Sample ID | Kv at 100° C. (cSt) | Kv at 40° C. (cSt) | VI | PPD (° C.) | Noack (wt %) |
|---|---|---|---|---|---|---|---|
| Ester #1 | $C_9$-Ester | 25304-34 | 3.7 | 16.7 | 15 | −42 | 10.65 |
| Ester #2 | $C_{10}$-Ester | 25304-31 | 4.1 | 19.8 | 08 | −21 | — |
| Ester #3 | $C_{12}$-Ester | 25304-37 | 5.2 | 26.5 | 26 | 0 | — |

The viscosities of the neat esters are generally low. For example, the polar $C_9$-ester has viscosity of 3.7 cSt at 100° C. and low pour point of −42° C. The Noack volatility of the $C_9$-ester was found to be 10.65 wt %. The unique combination of low viscosity and low volatility may be used to formulate engine oils in which very low base stock viscosity (<5 cSt at 100° C.) may be required, e.g., for greater fuel economy.

We found that cyclohexanoate esters are very effective polar co-base stocks for PAO and GTL fluids and can be blended with these non-polar base stocks to obtain clear and bright liquids from very low to very high concentrations.

Examples of Blends of Various PAO and Cyclohexanoate Esters and Properties Thereof Blend properties of various hydrocarbon base stocks like PAO, Group III, and cyclohexanoate esters are shown in Tables 2-7 below. The wt % ratios of cyclohexanoate esters were blended with hydrocarbon fluids in various ratios, such as 100:0, 95:05, 90:10, 80:20, 50:50 and 0:100. All the blend samples were clear and bright, which suggests that these two types of base stocks are miscible in each other. The viscosities, VI, and pour point temperatures are shown in the tables. The test methods for Kv at 100° C. (cSt) was ASTM D 445, for Kv at 40° C. (cSt) was ASTM D445, for viscosity index (VI) was ASTM D2270 and for pour point (° C.) was ASTM D97.

TABLE 2

(Lube properties of blend of PAO 6 and the $C_9$ cyclohexanoate ester of Example 1)

| Base Stock Type | PAO 6/ Cyclohexanoate (wt %) | Kv 100° C. (cSt) | Kv 40° C. (cSt) | VI | PP (° C.) |
|---|---|---|---|---|---|
| PAO 6* | 100:0 | 5.50 | 28.50 | 132 | −54.0 |
| PAO/Ester 95-5 | 95:5 | 5.37 | 30.20 | 111 | −59.7 |
| PAO/Ester 90-10 | 90:10 | 5.48 | 29.86 | 120 | −60.9 |
| PAO/Ester 80-20 | 80:20 | 5.16 | 26.82 | 123 | −60.9 |
| PAO Ester 50-50 | 50:50 | 4.45 | 21.35 | 122 | −54.0 |
| Ester $C_9$ Cyclohexanoate* | 00:100 | 3.70 | 16.70 | 115 | −42.0 |

*not examples of the present disclosure

Lube properties of blend of PAO 6 (SpectraSyn 6 polyalphaolefin of ExxonMobil Chemical) and $C_9$ cyclohexanoate ester are shown in Table 2. This data suggests that the two types of base stocks are miscible in each other. The viscosity index (VI) of the blends suggests that these blends have relatively high VI. The viscosity of high-VI fluid changes less dramatically with change in temperature compared with the viscosity change of a low-VI fluid. A practical consequence of this property is that fluid may not be a viscosity index improver (VII) in some applications. The presence of a VII is often undesirable because many tend to be unstable toward shear. Once the VII begins to break down, the fully formulated fluid goes "out of grade" (i.e., fails to retain the original viscosity grade). Other important physical properties of PAO and ester blends are shown in Table 2. All products have very low pour points. This property makes the fluid very attractive in the cold-climate applications.

The pour point of PAO 6 was −54° C., while the pour point of $C_9$ cyclohexanoate ester was −42° C. The pour point of blends was surprising and unexpected. The pour points of blends of PAO 6 and $C_9$-cyclohexanoate esters in ratios of 95:05, 90:10, and 80:20 are shown in Table 2, last column. The blend pour points are even lower than original fluid.

TABLE 3

(Lube properties of blend of SpectraSyn Ultra 150 and $C_9$ cyclohexanoate ester)

| Base Stock Type | SpectraSyn Ultra 150/Cyclohexanoate (wt %) | Kv 100° C. (cSt) | Kv 40° C. (cSt) | VI | PP (° C.) |
|---|---|---|---|---|---|
| SpectraSyn Ultra 150* | 100:0 | 150.00 | 1500.00 | 218 | −33.0 |
| SS150/Ester 95-5 | 95:5 | 119.56 | 1117.69 | 212 | −42.0 |
| SS150/Ester 90-10 | 90:10 | 97.87 | 869.11 | 207 | −48.0 |
| SS150/Ester 80-20 | 80:20 | 66.31 | 533.70 | 201 | −51.0 |
| SS150 Ester 50-50 | 50:50 | 22.01 | 136.41 | 190 | −48.0 |
| Ester $C_9$ Cyclohexanoate* | 00:100 | 3.70 | 16.70 | 115 | −42.0 |

*not examples of the present disclosure

Lube properties of the blend of SpectraSyn Ultra 150 and $C_9$ cyclohexanoate ester are shown in Table 3. SpectraSyn Ultra 150 is high viscosity index polyalphaolefin (PAO) commercially available from ExxonMobil Chemical. The data in the table suggests that these two types of base stocks are miscible in each other. The viscosity index (VI) of the blends suggests that these blends have relatively high VI. The viscosity of high-VI fluid changes less dramatically with change in temperature compared with the viscosity change of a low-VI fluid. A practical consequence of this property is that fluid may not act as a viscosity index improver (VII) in some applications. The presence of a VII is often undesirable because many tend to be unstable toward shear. Once the VII begins to break down, the fully formulated fluid goes "out of grade" (i.e., fail to retain the original viscosity grade). Other important physical properties of PAO and ester blends are shown in Table 3. All products have very low pour points. This property makes the fluid very attractive in cold-climate applications.

The pour point of SpectraSyn Ultra 150 was −33° C., while the pour point of the $C_9$ cyclohexanoate ester was −42° C. The pour point of blends was surprising and unexpected. The pour points of blends of SpectraSyn Ultra 150 and the $C_9$-cyclohexanoate esters in the ratio of 95:05, 90:10, 80:20 and 50:50 are shown in Table 3, last column. The blend pour points are even lower than original fluid. These fluids are very unique. For example, the fluid of blend 80:20 has very high VI of 201 with exceptionally low PP of −51° C.

TABLE 4

(Lube properties of blend of Visom and $C_9$ cyclohexanoate ester)

| Base Stock Type | Visom/ Cyclohexanoate (wt %) | Kv 100° C. (cSt) | Kv 40° C. (cSt) | VI | PP (° C.) |
|---|---|---|---|---|---|
| Visom* | 100:0 | 3.87 | 16.21 | 137 | −27.0 |
| Visom/Ester 95-5 | 95:5 | 3.69 | 16.03 | 118 | −30.0 |
| Visom/Ester 90-10 | 90:10 | 3.75 | 16.57 | 116 | −30.0 |

TABLE 4-continued (Lube properties of blend of Visom and $C_9$ cyclohexanoate ester)

| Base Stock Type | Visom/ Cyclohexanoate (wt %) | Kv 100° C. (cSt) | Kv 40° C. (cSt) | VI | PP (° C.) |
|---|---|---|---|---|---|
| Visom/Ester 80-20 | 80:20 | 3.73 | 15.81 | 127 | −36.0 |
| Visom/Ester 50-50 | 50:50 | 3.64 | 15.26 | 126 | −45.0 |
| $C_9$ Cyclohexanoate ester* | 00:100 | 3.70 | 16.70 | 115 | −42.0 |

*not examples of the present disclosure

Lube properties of blend of Visom and $C_9$ cyclohexanoate ester are shown in Table 4. Visom base stocks are ExxonMobil's Visom branded Group III+ base stocks. Visom is primarily iso-paraffins as compared to some other Group III base stocks that made from hydrocracker bottoms that may content significant naphthene. Visom is essentially slack wax that has been upgraded to base stock with high V.I., low volatility and good cold-cranking properties. Visom is created through wax isomerization and has high viscosity index because of its high paraffin content.

The data in the Table 4 suggest that the Visom and $C_9$ cyclohexanoate ester base stocks are miscible in each other. The viscosity index (VI) of the blends suggests that these blends have relatively high VI. Other important physical properties of Visom and ester blends are shown in Table 4. All products have very low pour points. The property of low pour point makes the fluid very attractive in the cold-climate applications.

The pour point of Visom was −27° C., while pour point of $C_9$ cyclohexanoate ester was −42° C. The pour point of blends was surprising and unexpected. The pour points of blend of Visom and $C_9$-cyclohexanoate esters in the ratio of 95:05, 90:10, 80:20 and 50:50 are shown in Table 4, last column. The pour point of the 50:50 blend was −45° C., which was lower than individual fluids.

TABLE 5

(Lube properties of blend of PAO 6 and $C_{10}$ cyclohexanoate ester)

| Base Stock Type | PAO 6/$C_{10}$ Cyclohexanoate (wt %) | Kv 100° C. (cSt) | Kv 40° C. (cSt) | VI | PP (° C.) |
|---|---|---|---|---|---|
| PAO 6* | 100:0 | 5.50 | 28.50 | 132 | −54.0 |
| PAO/Ester 95-5 | 95:5 | 5.63 | 30.20 | 127 | |
| PAO/Ester 90-10 | 90:10 | 5.51 | 29.22 | 127 | |
| PAO/Ester 80-20 | 80:20 | 5.33 | 27.59 | 128 | −57.0 |
| PAO Ester 50-50 | 50:50 | 4.76 | 23.35 | 126 | |
| Ester $C_{10}$ Cyclohexanoate* | 00:100 | 4.10 | 19.80 | 108 | −21.0 |

*not examples of the present disclosure

Lube properties of blend of PAO 6 and the $C_{10}$ cyclohexanoate ester are shown in Table 5. This data suggests that these two types of base stocks are miscible in each other. The viscosity index (VI) of the blends suggests that these blends have relatively high VI. Other important physical properties of PAO and ester blends are shown in Table 5.

The pour point of PAO 6 was −54° C., while pour point of $C_{10}$ cyclohexanoate ester was −21° C. The pour point of the PAO 6 and $C_{10}$-cyclohexanoate ester 80:20 blend was −57° C., which was surprising and unexpected as it was lower than the individual fluids.

TABLE 6

(Lube properties of blend of SpectraSyn Ultra 150 and $C_{10}$ cyclohexanoate ester)

| Base Stock Type | SpectraSyn Ultra 150/Cyclohexanoate (wt %) | Kv 100° C. (cSt) | Kv 40° C. (cSt) | VI | PP (° C.) |
|---|---|---|---|---|---|
| SpectraSyn Ultra 150* | 100:0 | 150.00 | 1500.00 | 218 | −33.0 |
| SS150/Ester 95-5 | 95:5 | 120.06 | 1130.42 | 211 | |
| SS150/Ester 90-10 | 90:10 | 98.80 | 893.64 | 206 | |
| SS150/Ester 80-20 | 80:20 | 62.87 | 485.50 | 204 | −48.0 |
| SS150 Ester 50-50 | 50:50 | 23.25 | 143.95 | 192 | |
| Ester $C_{10}$ Cyclohexanoate* | 00:100 | 4.10 | 19.80 | 108 | −21.0 |

*not examples of the present disclosure

Lube properties of blend of SpectraSyn Ultra 150 and $C_{10}$ cyclohexanoate ester are shown in Table 6. SpectraSyn Ultra 150 is high viscosity index polyalphaolefin (PAO) commercially available from ExxonMobil Chemical. The data in the table suggest that these two types of base stocks are miscible in each other. The viscosity index (VI) of the blends was very high. The viscosity of a high-VI fluid changes less dramatically with change in temperature compared with the viscosity change of a low-VI fluid. A practical consequence of this property is that fluid may not be a viscosity index improver (VII) in some applications. The presence of a VII is often undesirable because many tend to be unstable toward shear. Once the VII begins to break down, the fully formulated fluid goes "out of grade" (i.e., fail to retain the original viscosity grade).

The pour point of the SpectraSyn Ultra 150 was −33° C., while pour point of the $C_{10}$ cyclohexanoate ester was −21° C. It was surprising and unexpected that the pour point of the SpectraSyn Ultra 150 and $C_{10}$-cyclohexanoate ester 80:20 blend was −48° C. which is lower than the individual fluids. It was also surprising and unexpected that the fluid of the blend 80:20 has very high VI of 204 with low PP of −48° C.

TABLE 7

(Lube properties of blend of Visom and $C_{10}$ cyclohexanoate ester)

| Base Stock Type | Visom/$C_{10}$ Cyclohexanoate (wt %) | Kv 100° C. (cSt) | Kv 40° C. (cSt) | VI | PP (° C.) |
|---|---|---|---|---|---|
| Visom* | 100:0 | 3.87 | 16.21 | 137 | −27.0 |
| Visom/Ester 95-5 | 95:5 | 3.82 | 15.70 | 141 | |
| Visom/Ester 90-10 | 90:10 | 3.79 | 15.65 | 138 | |
| Visom/Ester 80-20 | 80:20 | 3.78 | 16.05 | 129 | −30.0 |
| Visom/Ester 50-50 | 50:50 | 3.82 | 15.95 | 136 | |
| $C_{10}$ Cyclohexanoate ester* | 00:100 | 4.10 | 19.80 | 108 | −21.0 |

*not examples of the present disclosure

Lube properties of blend of Visom and $C_{10}$ cyclohexanoate ester are shown in Table 7. Visom base stocks are ExxonMobil's Visom branded Group III+ base stocks. Visom is primarily iso-paraffins as compared to some other Group III base stocks that made from hydrocracker bottoms that may content significant naphthene. Visom is essentially slack wax that has been upgraded to base stock with high V.I., low volatility and good cold-cranking properties.

The data in the table suggests that these two types of base stocks are miscible in each other. The viscosity index (VI) of the blends suggests that these blends have relatively high VI. Other important physical properties of Visom and ester blends are shown in Table 7.

The pour point of Visom was −27° C., while pour point of $C_{10}$ cyclohexanoate ester was −21° C. It was surprising and unexpected that the pour point of Visom and $C_{10}$-cyclohexanoate ester 80:20 blend was −30° C., which is lower than the individual fluids. Thus, this exemplary blend data demonstrates that unique blends can be prepared from hydrocarbon fluids and cyclohexanoate esters.

Examples of Blends of GTL Fluid and Cyclohexanoate Esters and Properties Thereof The wt % ratios of GTL fluid and cyclohexanoate ester (DINCH ester) are given in Table 8 below. The first and last samples (GTL and DINCH ester) are neat base stocks. The remaining samples are 5%, 10%, 20% and 50% DINCH ester blended with GTL fluid. All the blend samples were clear and bright suggesting that these two types of base stocks are miscible in each other. The viscosities, VI, pour point (PP) temperature, and aniline point results are shown in Table 8. The test methods for Kv at 100° C. (cSt) was ASTM D445, for Kv at 40° C. (cSt) was ASTM D445, for viscosity index (VI) was ASTM D2270 and for pour point (° C.) was ASTM D97. Aniline points are measured using ASTM D611. Aniline points are widely used as indicators of lubricant polarity. The aniline point measures the temperature at which equal amount of test oil and aniline becomes completely miscible. It is a good indicator of fluid polarity. Usually, a higher aniline point indicates a lower fluid polarity for fluids of comparable viscosity. The aniline point of GTL fluid was 130.1, while aniline points of neat cyclohexanoate ester was 0. As the proportion of ester increases, aniline point decreases.

This data suggests that these two types of base stocks are miscible in each other and polarity of the blend can be improved without affecting VI of the products. The cyclohexanoate ester has very low viscosity of 3.94 cSt at 100° C. and has very low pour point of −60.6° C. The viscosity index (VI) of the cyclohexanoate ester was low (57) while the VIs of blends were quite high. Thus, using the blending approach of the present disclosure, one can get a fluid with high viscosity.

TABLE 8

(Lube properties of GTL and cyclohexanoate ester (DINCH) blends)

| Base Stock Type | GTL/ DINCH wt % | Kv 100° C. (cSt) | Kv 40° C. (cSt) | VI | PP (° C.) | Aniline Point (° C.) |
|---|---|---|---|---|---|---|
| GTL* | 100:0 | 6.1 | 29.7 | 145 | −18 | 130.1 |
| GTL/Ester 95-5 | 95:5 | 5.9 | 29 | 143 | −12 | 125.9 |
| GTL/Ester 90-10 | 90:10 | 5.7 | 27.8 | 142 | −15 | 122.2 |
| GTL/Ester 80-20 | 80:20 | 5.5 | 26.55 | 140 | −36 | 113.7 |
| GTL/Ester 50-50 | 50:50 | 4.8 | 23.2 | 121 | −24 | 82.4 |
| DINCH* | 0:100 | 3.9 | 20.35 | 57 | −60.6 | 0 |

*not examples of the present disclosure

Examples of Blends of Group I Fluid and Cyclohexanoate Esters and Properties Thereof The wt % ratios of Group I fluid and $C_9$ cyclohexanoate ester are given in Table 9 below. The first and last samples (Group I and $C_9$ cyclohexanoate ester) are neat base stocks. The middle sample is 80:20 blend of Group I and $C_9$ cyclohexanoate ester. The blend sample was clear and bright suggesting that these two types of base stocks are miscible in each other. The viscosities, VI, and pour point (PP) temperature are shown in Table 9. This data suggests that these two types of base stocks are miscible in each other and VI of group I can be improved.

TABLE 9

(Lube properties of Group I fluid and cyclohexanoate ester of Example 1 blend)

| Base Stock Type | Group I/$C_9$ Cyclohexanoate (wt %) | Kv 100° C. (cSt) | Kv 40° C. (cSt) | VI | PP (° C.) |
|---|---|---|---|---|---|
| Group-I* | 100:00 | 4.05 | 20.78 | 92 | −15.0 |
| Group I/Ester 80-20 | 80:20 | 3.98 | 19.20 | 104 | −18.0 |
| $C_9$ Cyclohexanoate* | 00:100 | 3.70 | 16.70 | 115 | −42.0 |

*not an example of the present disclosure

Examples of Blends of Group II Fluid and Cyclohexanoate Esters and Properties Thereof The wt % ratios of Group II fluid and $C_9$ cyclohexanoate ester are given in Table 10 below. The first and last samples (Group II and $C_9$ cyclohexanoate ester) are neat base stocks. The middle sample is 80:20 blend of Group II and $C_9$ cyclohexanoate ester. The blend sample was clear and bright suggesting that these two types of base stocks are miscible in each other. The viscosities, VI, and pour point (PP) temperature are shown in Table 10. This data suggests that these two types of base stocks are miscible in each other and VI of group II can be improved.

TABLE 10

(Lube properties of Group II fluid and cyclohexanoate ester of Example 1 blend)

| Base Stock Type | Chevron Group II/$C_9$ Cyclohexanoate (wt %) | Kv 100° C. (cSt) | Kv 40° C. (cSt) | VI | PP (° C.) |
|---|---|---|---|---|---|
| Chevron Group-II* | 100:00 | 6.50 | 43.00 | 98 | −12.0 |
| Group II/Ester 80-20 | 80:20 | 6.10 | 38.62 | 103 | −18.0 |
| $C_9$ Cyclohexanoate* | 00:100 | 3.70 | 16.70 | 115 | −42.0 |

*not an example of the present disclosure

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. All numerical values within the detailed description and the claims herein are modified by "about" or "approximately" the indicated value, and take into account experimental error and variations that would be expected by a person having ordinary skill in the art.

What is claimed is:

1. A lubricant blend comprising: a first base stock of one or more alkyl cyclohexyl 1,2-dicarboxylate esters at 10 [1] wt % to 50 wt % based on the total weight of the blend, and a second base stock at 90 [99] wt % to 50 wt % based on the total weight of the blend, wherein the second base stock is a $C_{10}$ poly-α-olefin, wherein the pour point of the lubricant is 3 [0] to 9 [15]° C. lower than the lowest of the pour points of the first base stock and the second base stock, wherein the one or more alkyl cyclohexyl 1,2-dicarboxylate esters is di(n-nonyl) 1,2-cyclohexanedicarboxylate, wherein the kinematic viscosity of the $C_{10}$ poly-α-olefin ranges from 6 to 150 centistokes, and wherein the combination of the first base stock and the second base stock comprise from 77 wt. % to 100 wt. % based on the total weight of the blend.

2. The lubricant blend of claim 1, wherein the one or more alkyl cyclohexyl 1,2-dicarboxylate esters are present at 10 [2] wt % to 20 [25] wt % and the $C_{10}$ poly-α-olefin at 90 [98] wt % to 80 [75] wt %.

3. The lubricant blend of claim 1, further comprising 10 wt % or less based on the total weight of the blend, of one or more additives chosen from detergents, dispersants, antioxidants, anti-wear additives, pour point depressants, viscosity index modifiers, friction modifiers, defoaming agents, corrosion inhibitors, wetting agents, densifiers, fluid-loss additives, rust inhibitors, and combinations thereof.

4. The lubricant blend of claim 1, wherein the lubricant is a lubricant oil, an industrial oil, a hydrolytic oil, an engine oil, or a grease.

5. A method of making a lubricant blend comprising:

providing a first base stock of one or more alkyl cyclohexyl 1,2-dicarboxylate esters at 10 [1] wt % to 50 wt % based on the total weight of the blend, and a second base stock at 90 [99] wt % to 50 wt % based on the total weight of the blend, wherein the second base stock is a $C_{10}$ poly-α-olefin, and blending the first base stock and the second base stock to form a lubricant blend, wherein the pour point of the lubricant blend is 3 [0] to 9 [15]° C. lower than the lowest of the pour points of the first base stock and the second base stock, wherein the one or more alkyl cyclohexyl 1,2-dicarboxylate esters is di(n-nonyl) 1,2-cyclohexanedicarboxylate, wherein the kinematic viscosity of the $C_{10}$ poly-α-olefin ranges from 6 to 150 centistokes, and wherein the combination of the first base stock and the second base stock comprise from 77 wt. % to 100 wt. % based on the total weight of the blend.

6. The method of claim 5, wherein the one or more alkyl cyclohexyl 1,2-dicarboxylate esters are present at 10 [2] wt % to 20 [25] wt % and the $C_{10}$ poly-α-olefin at 90 [98] wt % to 80 [75] wt %.

7. The method of claim 5, further comprising providing 10 wt % or less based on the total weight of the blend, of one or more additives chosen from detergents, dispersants, antioxidants, anti-wear additives, pour point depressants, viscosity index modifiers, friction modifiers, defoaming agents, corrosion inhibitors, wetting agents, densifiers, fluid-loss additives, rust inhibitors and combinations thereof, and blending the one or more additives with the first base stock and the second base stock to form a lubricant blend.

8. The method of claim 5, wherein the lubricant is a lubricant oil, an industrial oil, a hydrolytic oil, an engine oil, or a grease.

* * * * *